US011512551B2

(12) United States Patent
Alexander et al.

(10) Patent No.: US 11,512,551 B2
(45) Date of Patent: Nov. 29, 2022

(54) EXTRUDABLE BALL FOR MULTIPLE ACTIVATIONS

(71) Applicants: David Alexander, Houston, TX (US); Daniel R. Hart, Sugar Land, TX (US); Andrew D. Ponder, Houston, TX (US); Irvin Turcios, Humble, TX (US)

(72) Inventors: David Alexander, Houston, TX (US); Daniel R. Hart, Sugar Land, TX (US); Andrew D. Ponder, Houston, TX (US); Irvin Turcios, Humble, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 82 days.

(21) Appl. No.: 16/995,603

(22) Filed: Aug. 17, 2020

(65) Prior Publication Data

US 2022/0049569 A1 Feb. 17, 2022

(51) Int. Cl.
*E21B 33/12* (2006.01)
*E21B 34/14* (2006.01)

(52) U.S. Cl.
CPC ..... *E21B 33/12* (2013.01); *E21B 34/142* (2020.05); *E21B 2200/06* (2020.05)

(58) Field of Classification Search
CPC ..... E21B 33/12; E21B 34/142; E21B 2200/06
See application file for complete search history.

(56) References Cited

U.S. PATENT DOCUMENTS

| | | | | |
|---|---|---|---|---|
| 8,991,505 | B2 * | 3/2015 | Fleckenstein | E21B 43/26 166/373 |
| 2003/0127227 | A1 * | 7/2003 | Fehr | E21B 34/10 166/306 |
| 2006/0243455 | A1 * | 11/2006 | Telfer | E21B 23/006 166/386 |
| 2011/0108284 | A1 * | 5/2011 | Flores | E21B 34/14 166/373 |
| 2011/0198100 | A1 * | 8/2011 | Braekke | E21B 34/14 166/386 |

(Continued)

FOREIGN PATENT DOCUMENTS

| | | | |
|---|---|---|---|
| WO | 2007005765 | A1 | 1/2007 |
| WO | 2016145540 | A1 | 9/2016 |

OTHER PUBLICATIONS

International Search Report and Written Opinion for International Application No. PCT/US2021/046125; International Filing Date Aug. 16, 2021; dated Nov. 10, 2021; 9 Pages.

*Primary Examiner* — Steven A MacDonald
(74) *Attorney, Agent, or Firm* — Cantor Colburn LLP

(57) ABSTRACT

A work string and method of performing a downhole operation is disclosed. The work string includes a first tool having a first ball seat configured to activate when a first activation pressure is applied to a plug seated at the first ball seat, and a second tool having a second ball seat configured to activate when a second activation pressure is applied to the plug when seated at the second ball seat, wherein the first activation pressure is different than the second activation pressure. A plug is dropped through a string in a wellbore. The first activation pressure is applied when the plug is at the first tool to activate the first tool. The second activation pressure is applied when the plug is at the second tool to activate the second tool.

3 Claims, 7 Drawing Sheets

(56) References Cited

U.S. PATENT DOCUMENTS

| | | | | |
|---|---|---|---|---|
| 2011/0278017 | A1* | 11/2011 | Themig | E21B 34/14 166/373 |
| 2012/0073819 | A1* | 3/2012 | Richard | E21B 34/14 166/308.1 |
| 2012/0073828 | A1* | 3/2012 | Churchill | E21B 34/06 166/373 |
| 2013/0112436 | A1* | 5/2013 | Fleming | E21B 43/26 166/386 |
| 2013/0118732 | A1* | 5/2013 | Chauffe | E21B 34/06 166/250.04 |
| 2014/0116721 | A1* | 5/2014 | Hofman | E21B 23/00 166/373 |
| 2014/0138101 | A1* | 5/2014 | Arabsky | E21B 34/14 166/387 |
| 2014/0246209 | A1* | 9/2014 | Themig | E21B 23/006 166/374 |
| 2015/0068762 | A1* | 3/2015 | Naedler | E21B 34/14 166/373 |
| 2015/0136416 | A1* | 5/2015 | Churchill | E21B 23/00 166/373 |
| 2015/0167424 | A1* | 6/2015 | Richards | E21B 33/138 166/386 |
| 2016/0053598 | A1 | 2/2016 | Fehr et al. | |
| 2016/0326833 | A1* | 11/2016 | Luke | E21B 34/08 |
| 2017/0067314 | A1* | 3/2017 | Flores Perez | E21B 34/14 |
| 2018/0163509 | A1* | 6/2018 | Churchill | E21B 47/09 |
| 2018/0223628 | A1* | 8/2018 | Brandsdal | E21B 34/14 |
| 2018/0298728 | A1* | 10/2018 | Saraya | E21B 34/14 |
| 2018/0320478 | A1* | 11/2018 | Themig | E21B 43/25 |

* cited by examiner

EXTRUDABLE BALL FOR MULTIPLE ACTIVATIONS

BACKGROUND

In the resource recovery industry, a tool string disposed within a wellbore in a formation can include multiple tools, each tool having a device that is activated by a ball seat (or more generically, a profile). A ball seat operates by dropping a plug through the tool string to land on the ball seat, thereby plugging a channel of the ball seat. Applying a fluid pressure on the plug moves the ball seat from an original position to an activation position. Increasing the fluid pressure on the plug above a selected pressure threshold then forces the plug through the channel of the seat, thereby relieving the pressure on the seat and allowing the seat to return to its original position. When different tools have different activation pressures, a different plug is typically required to be dropped through the tool string for each tool. This also requires that the plugs be dropped in a particular order.

SUMMARY

In one aspect, a method of performing a downhole operation is disclosed. A plug is dropped through a string in a wellbore, the string having a first tool configured to be activated at a first activation pressure when the plug is seated at the first tool and a second tool configured to be activated at a second activation pressure when the plug is seated at the second tool, the second activation pressure being different from the first activation pressure. The first activation pressure is applied when the plug is at the first tool to activate the first tool. The second activation pressure is applied when the plug is at the second tool to activate the second tool.

In another aspect, a work string is disclosed. The work string includes a first tool having a first ball seat configured to activate when a first activation pressure is applied to a plug seated at the first ball seat, and a second tool having a second ball seat configured to activate when a second activation pressure is applied to the plug when seated at the second ball seat, wherein the first activation pressure is different than the second activation pressure.

In yet another aspect, a work string is disclosed. The work string including a first tool having a first ball seat, wherein a plug is extruded through the first ball seat when a fluid pressure is applied to the plug above an extrusion pressure of the first ball seat, and a second tool having a second ball seat, wherein the plug is activated with a fluid pressure is applied to the plug above an activation pressure of the second ball seat when the plug is seated at the second ball seat. The first tool receives the plug before the second tool receives the plug and the plug at the first ball seat blocks a fluid pressure at the second tool.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
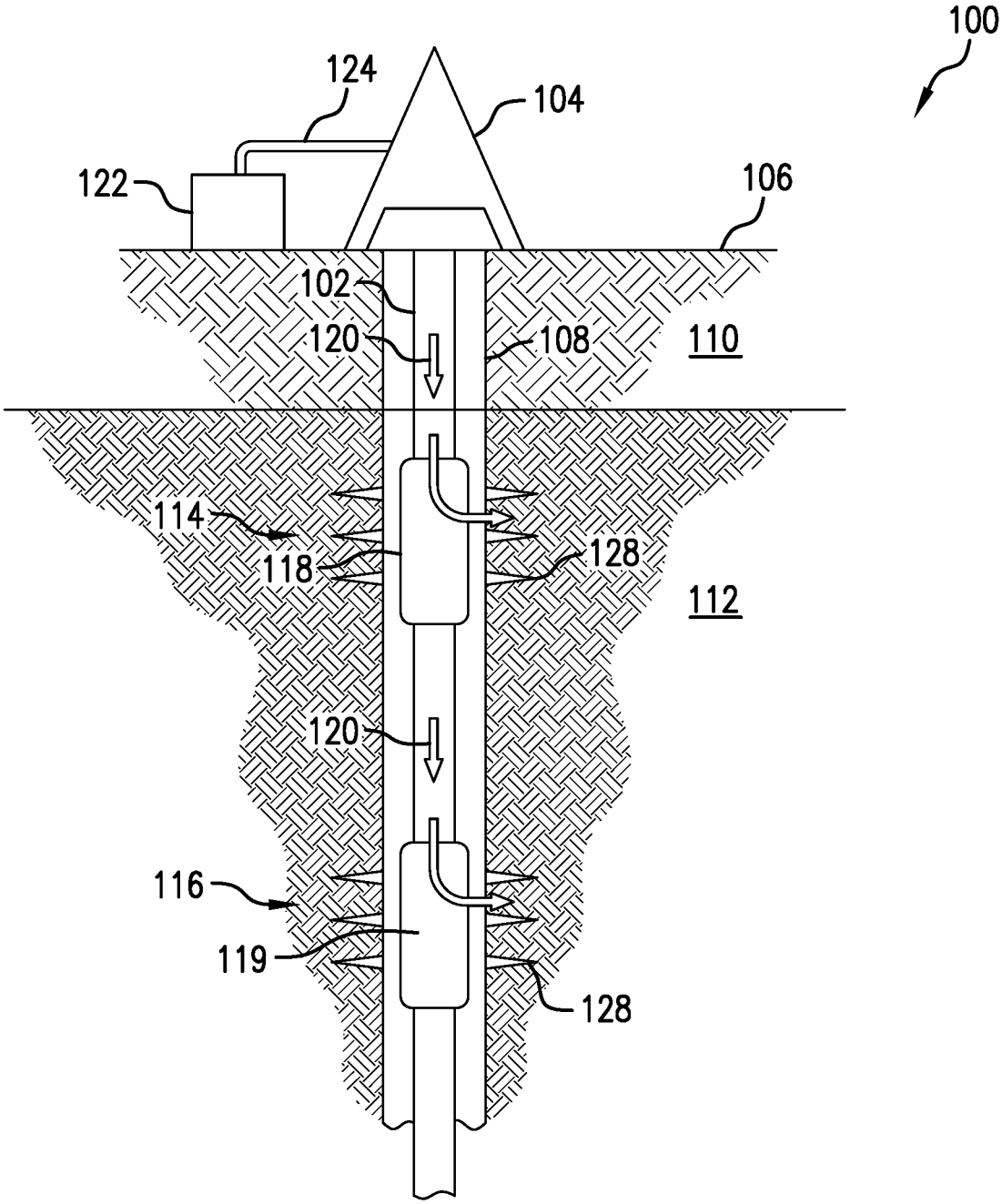
FIG. 1 shows a system for use in a downhole environment is shown in an illustrative embodiment.

Referring to FIG. 1, a system 100 for use in a downhole environment is shown in an illustrative embodiment. The system 100 includes a work string 102 extending from a rig 104 located at a surface location 106. The work string 102 extends through a wellbore 108 penetrating a formation 110 and a reservoir 112 in the formation 110. The work string 102 can be used to perform production, stimulation or other downhole operation. The work string 102 includes a first tool 114 and a second tool 116 and can also include additional tools (not shown). The first tool 114 includes a first device 118 for performing a first downhole operation and the second tool 116 includes a second device 119 for performing a second downhole operation. The first device 118 can perform the same operation or a different operation from the second device 119. As discussed herein for illustrative purposes only, at least one of the first device 118 and the second device 119 is a frac assembly, although other devices can also be activated using the methods disclosed herein.

The first device 118 and the second device 119 each include a ball seat therein for activating their respective downhole operations. A plug or ball can be dropped into the work string 102 in order to land at the ball seat of the first device 118 to activate the first device 118. After being extruded from the ball seat of the first device 118, the plug lands at the ball seat of the second device 119 in order to activate the second device 119.

The system 100 further includes a fluid reservoir 122 at the surface location 106 and a fluid pressure device 124 or pump for delivering a fluid 120 from the fluid reservoir 122 into the work string 102. The fluid pressure device 124 can control a fluid pressure applied to the fluid 120 in the work string 102, thereby controlling activation of the first device 118 and the second device 119.

Figure 2:
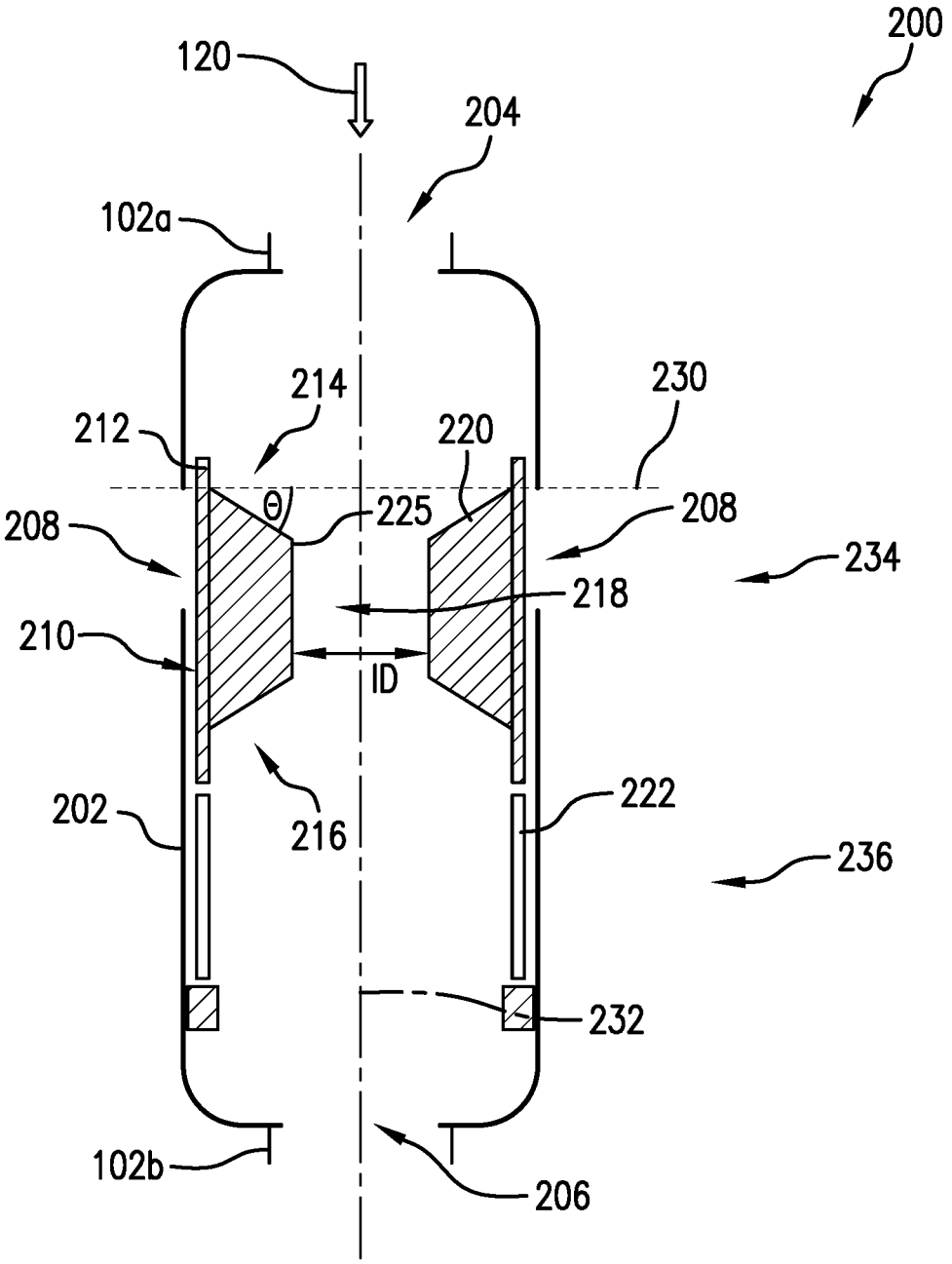
FIG. 2 shows a detailed diagram of an illustrative downhole device of the system.

FIG. 2 shows a detailed diagram of an illustrative downhole device 200 of the system 100, such as the first device 118 and the second device 119. The downhole device 200 includes a housing 202 coupled to the work string 102. The housing 202 includes an inlet 204 at an intersection of the housing 202 and a first section 102*a* of the work string 102. The housing 202 may also include an outlet 206 at an intersection of the housing 202 and a second section 102*b* of the work string 102. The housing 202 further includes port 208 on a side of the housing 202 for delivery of fluid 120 from the downhole device 200 into the reservoir 112. A ball seat 210 of the downhole device 200 moves axially to open or close the port 208. The port 208 can be a plurality of ports in various embodiments. The downhole device 200 may also simply block fluid pressure to the tools below, thereby only activating the tools above. In the illustrative example in which the downhole device 200 is a frac assembly, opening and closing the port 208 controls the flow of frac fluid into the reservoir 112.

The ball seat 210 can move between a first position 234 and a second position 236. The first position 234 is closer to the inlet 204 than the second position 236. When the ball seat 210 is in the first position, the sleeve 212 covers a port 208 of the downhole device 200, thereby closing the port 208. When the ball seat 210 is in the second position 236, the sleeve 212 is away from the port 208, thereby opening the port 208. A biasing device 222 such as a spring biases the ball seat 210 towards the inlet 204 or toward the first position 234.

The ball seat 210 includes a sleeve 212 that moves axially along an inner surface of the downhole device 200. The ball seat 210 has a fluid passage therethrough that includes a receiving section 214, a discharge section 216 and a constricted region or bore 218 between the receiving section 214 and the discharge section 216. An intersection between the receiving section 214 and the bore 218 forms a ball seat 225. An inner diameter (ID) of the ball seat 225, and hence of the bore 218, is selected so that a plug having a selected diameter settles on the ball seat. The receiving section 214 forms a funnel 220 having its small opening end at the ball seat 225. A taper angle θ of the funnel 220 is defined as an angle of declination from a plane 230 perpendicular to a longitudinal axis 232 of the funnel 220.

Figure 3:
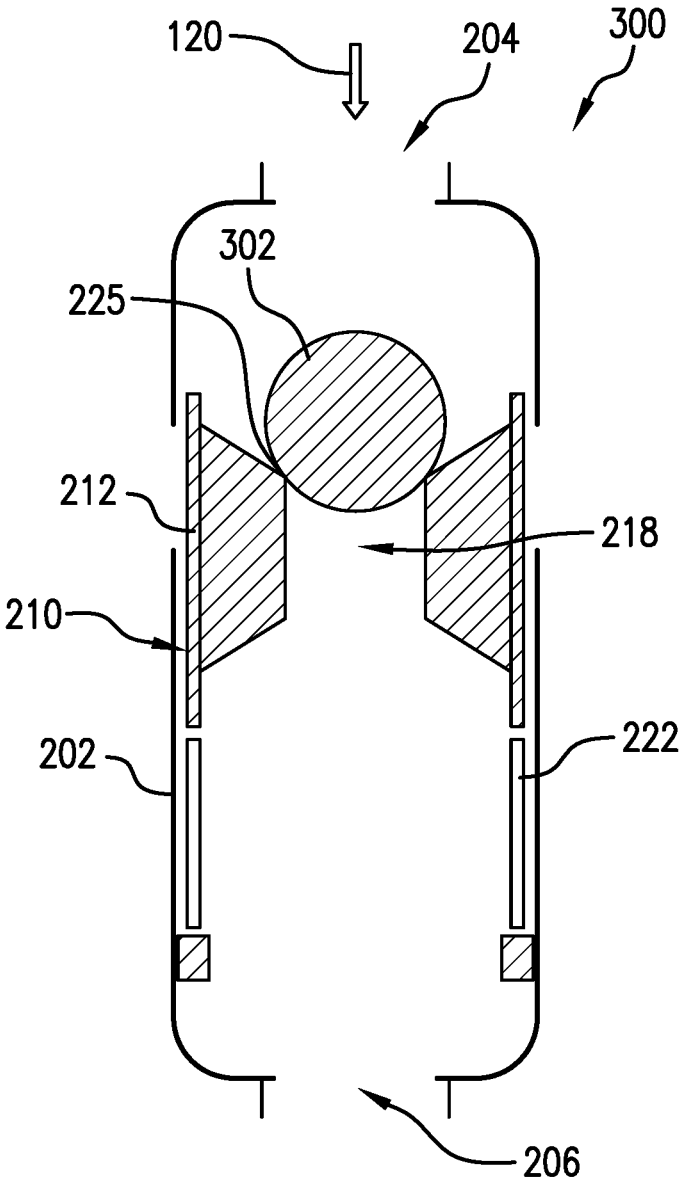
FIG. 3 shows a configuration of the downhole device with a plug seated at a ball seat.

FIG. 3 shows a configuration 300 of the downhole device 200 of FIG. 2 with a plug 302 seated at the ball seat 225. The plug 302 is dropped into the work string 102 at the surface and is allowed to settle onto the ball seat 225, thereby blocking the flow of fluid from the inlet 204 to the outlet 206.

Figure 4:
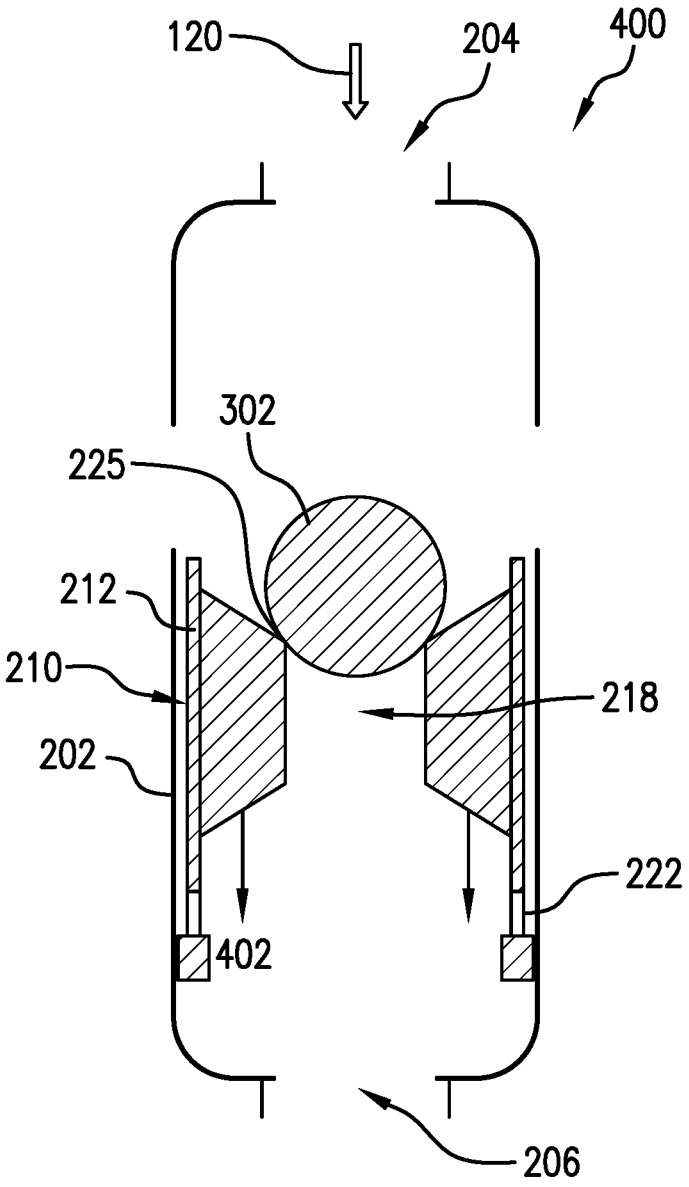
FIG. 4 shows a configuration the downhole device with the ball seat in a second position.

FIG. 4 shows a configuration 400 the downhole device 200 with the ball seat 210 in the second position 236. The ball seat 210 moves to the second position by applying an activation fluid pressure to the plug 302 seated at the ball seat 225. The fluid 120 enters the downhole device 200 from the inlet 204 and exerts the activation fluid pressure on the plug 302 and the ball seat 210, thereby moving the ball seat 210 from the first position 234 to the second position 236. The ball seat 210 is prevented from further motion toward the outlet 206 by the biasing device 222.

Figure 5:
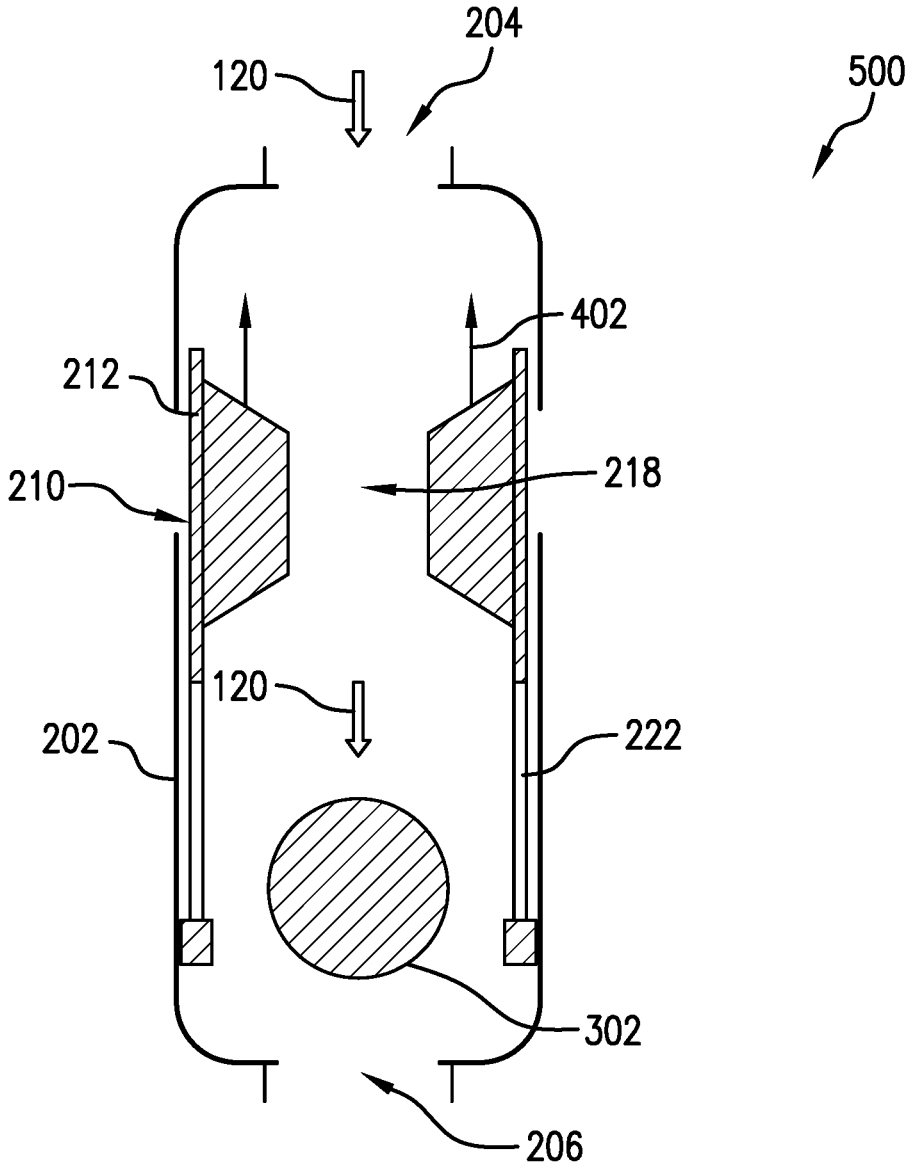
FIG. 5 shows a configuration of the downhole device with the plug discharged.

FIG. 5 shows a configuration 500 of the downhole device 200 with the plug discharged. The plug 302 is discharged by applying an extrusion fluid pressure on the plug 302 when the ball seat 210 is in the second position 236 to force the plug 302 through the bore 218. The extrusion fluid pressure is greater than the activation fluid pressure. Once the plug 302 is discharged, the pressure on the ball seat 210 is relieved. With no opposing force, the biasing device 222 returns the ball seat 210 to its first position 234 in which it covers, and thereby closes, port 208. In an alternate embodiment, the biasing device 222 can be replaced with a lock that allows the ball seat 210 to be locked into the open position.

The plug 302 can be an elastic plug capable of deforming and/or being compressed. An elastic range of deformation of the plug 302 is dependent on the material of the plug 302. In a relaxed state with no compressive force applied, the diameter of the plug 302 is greater than the inner diameter of the ball seat 225 and bore 218. When sufficiently compressed by compressive force, such as by a fluid pressure applied by the fluid pressure device 124, the plug 302 can be deformed or reduced in diameter such that it can pass through bore 218. In various embodiments, the plug 302 deforms within its elastic range while passing through bore 218. Thus, when the compressive force is removed (i.e., when the plug 302 is expelled from the bore at the discharge section 216), the plug 302 expands back to its original size and diameter.

Figure 6:
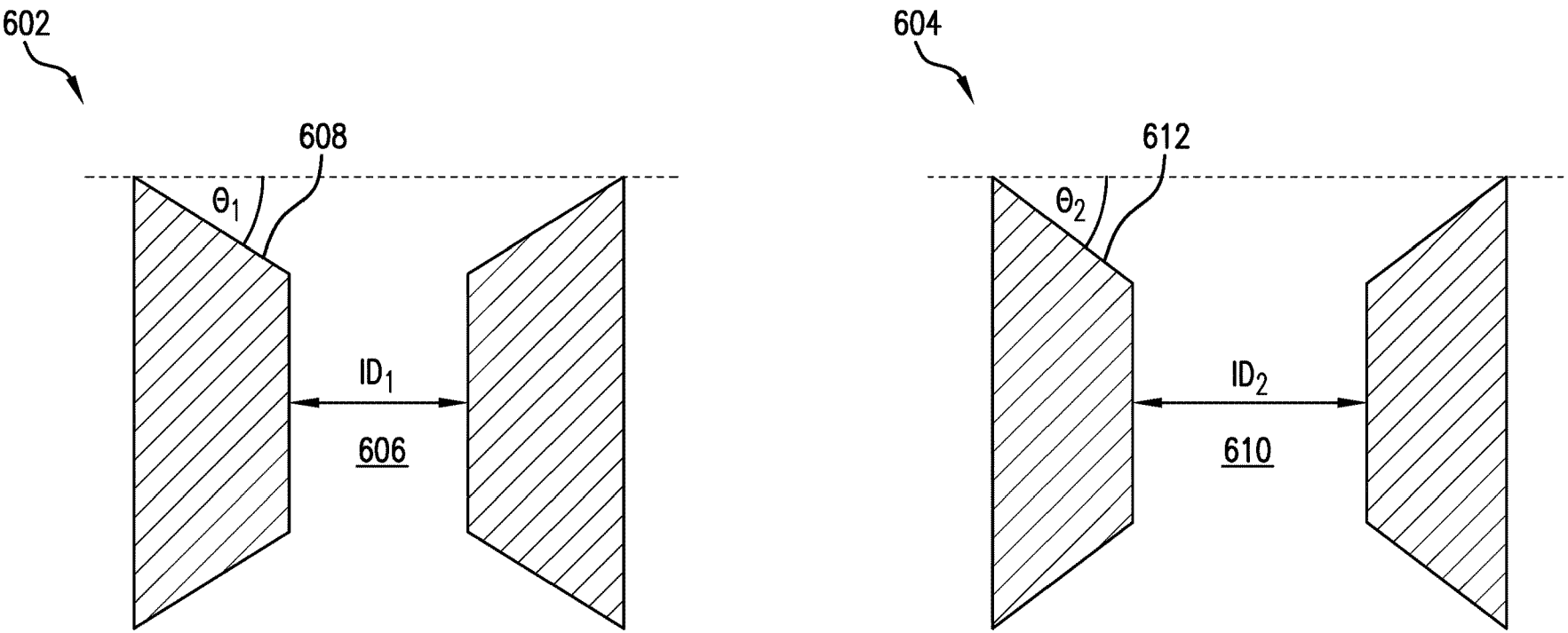
FIG. 6 shows illustrative ball seats suitable for use in the multiple tools of the work string of FIG. 1.

FIG. 6 shows illustrative ball seats 600 suitable for use in the multiple stages of the work string 102 of FIG. 1. A first ball seat 602 can be used at the first device 118 and the second ball seat 604 can be used at the second device 119. The first ball seat 602 and the second ball seat 604 can be activated at different fluid pressure with the same plug seated therein. In other words, with the plug seated at the first ball seat 602, the first ball seat 602 is activated by applying a first activation pressure, and with the same plug seated at the second ball seat 604, the second ball seat 604 is activated by applying a second activation pressure. The first activation pressure is different from the second activation pressure. The plug can be extruded through the first ball seat 602 applying a first extrusion pressure to the plug, and the plug can be extruded through the second ball seat 604 by applying a second extrusion pressure to the plug. The first extrusion pressure is different from the second extrusion pressure.

The values of the activation pressure and extrusion pressure for each of the first ball seat 602 and the second ball seat 604 is related to geometric parameters of the respective ball seats. A geometric parameter of a ball seat refers to at least one of an inner diameter of its bore and a taper angle of its funnel. The geometric parameter of a ball seat determines an extrusion pressure for a plug at the ball seat. Since the extrusion pressure defines an upper bound to the activation pressure of the ball seat, the geometric parameters of the ball seat can be selected to determine an extrusion pressure and an activation pressure for the ball seat.

The first ball seat 602 has a first bore 606 having a first inner diameter ($ID_1$) and a first funnel 608 defined by a first taper angle $\theta_1$. The second ball seat 604 has second bore 610 having a second inner diameter ($ID_2$) and a second funnel 612 defined by a second taper angle $\theta_2$. For illustrative purposes, the first inner diameter ($ID_1$) is less than the second inner diameter ($ID_2$) and the first taper angle $\theta_1$ is less than the second inner diameter $\theta_2$. Since $ID_1<ID_2$ and $\theta_1<\theta_2$, the first activation pressure is greater than the second activation pressure, when the same plug is seated with the first ball seat 602 as in the second ball seat 604.

Referring back to FIG. 1, in one aspect the first device 118 of the work string 102 includes the first ball seat 602 and the second device 119 includes the second ball seat 604. The first device 118 is activated by seating the plug at the first ball seat 602 and applying a first activation pressure. Applying a first extrusion pressure on the plug then discharges the plug from the first ball seat 602. The plug then descends through the work string 102 to seat itself at the second ball seat 604. The second device 119 is then activated by applying a second activation pressure to the plug. Applying a second extrusion pressure on the plug discharges the plug from the first ball seat.

In various aspects, the first ball seat 602 is manufactured with the first geometric parameters and second ball seat 604 is manufactures with the second geometric parameters. The first geometric parameters and second geometric parameters are selected to provide first activation pressure and second activation pressure to the first ball seat 602 and the second ball seat 604, respectively, for a selected plug. Therefore, the same plug can used to activate multiple tools of the work string.

It is to be understood that adjusting the bore size reduces an amount of hydraulic pressure needed to force the plug through the bore of the tool. In particular, the second hydraulic pressure is less than a hydraulic pressure for passing a plug through a bore having a single geometry (e.g., the first geometry) or bore size. The second hydraulic pressure can thus be controlled so as to apply a force on the plug that keeps compression of the plug within the elastic range.

Figure 7:
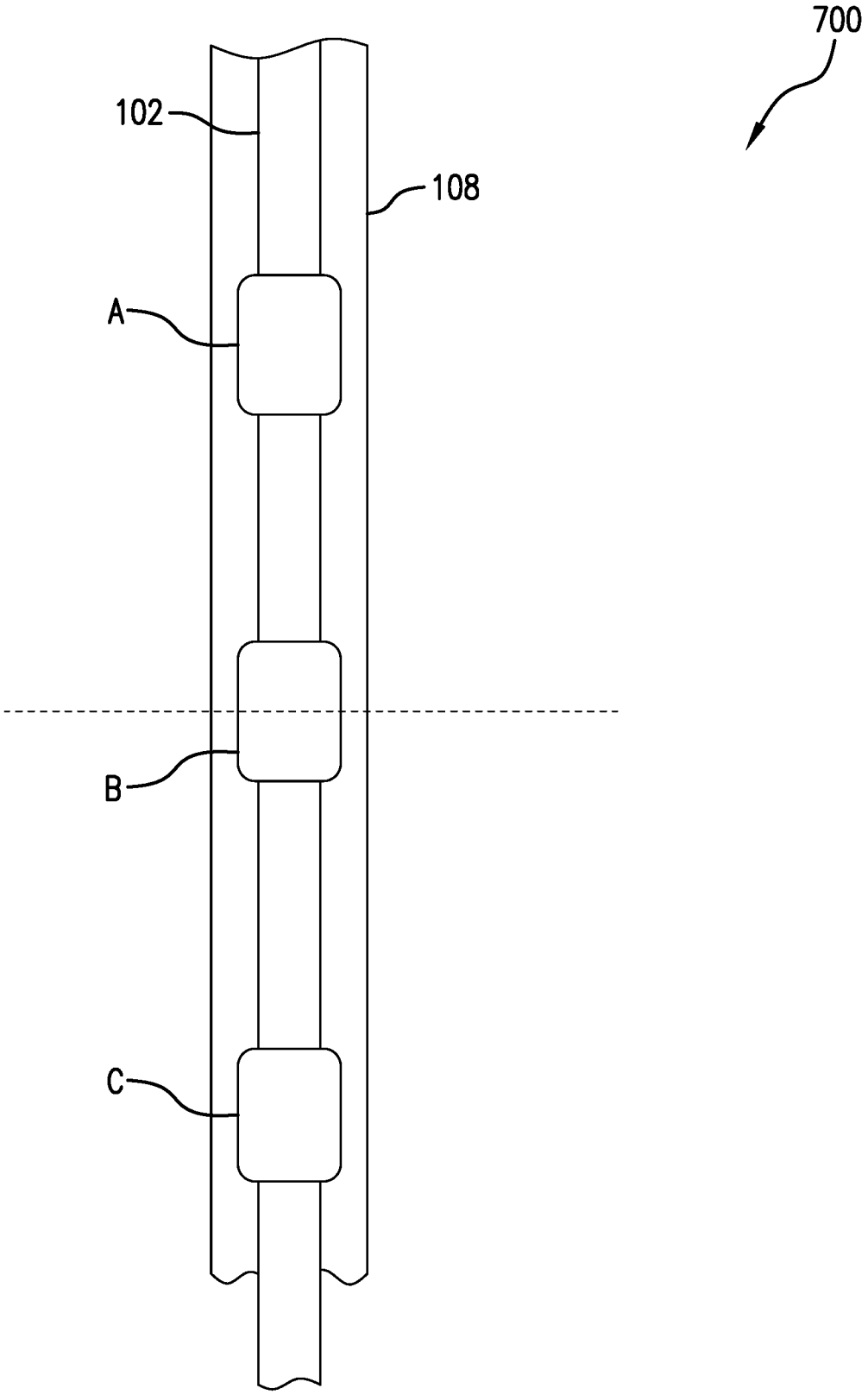
FIG. 7 shows a system illustrating operation of a work string having multiple tools.

FIG. 7 shows a system 700 illustrating operation of a work string 702 having multiple tools. The system 700 includes a work string 702 disposed in a wellbore 708. For illustrative purposes, the work string 702 includes three tools: Tool A, Tool B and Tool C, each having an associated ball seat. A plug dropped into the work string 702 is received in the order shown (i.e., Tool A first, Tool B second, and Tool C third). For illustrative purposes, Tool B includes only a ball seat and does not include a sleeve or other device that can be activated by a fluid pressure. In other words, a plug seated at the ball seat of Tool B only blocks a fluid pressure applied at the surface from being transmitted to Tool C. With a plug seated at Tool B, fluid pressure can be adjusted to activate Tool A, while not having an effect at Tool C. In a more general sense, the work string 702 can have multiple tools with a selected tool including only a ball seat. With a plug seated at the selected tool, a fluid pressure can be applied to activate or control those tools that are higher (closer to the surface) than the selected tool, while having no effect on those tools that are lower (further from the surface) than the selected tool.

While the invention disclosed herein is discussed with respect to a frac assembly, any activation device that includes moving a first member with respect a second member through hydraulic pressure on a plug at the first member is contemplated.

Set forth below are some embodiments of the foregoing disclosure:

Embodiment 1. A method of performing a downhole operation. The method includes dropping a plug through a string in a wellbore, the string having a first tool configured to be activated at a first activation pressure when the plug is seated at the first tool and a second tool configured to be activated at a second activation pressure when the plug is seated at the second tool, the second activation pressure being different from the first activation pressure, applying the first activation pressure when the plug is at the first tool to activate the first tool, and applying the second activation pressure when the plug is at the second tool to activate the second tool.

Embodiment 2. The method of any prior embodiment, wherein the first tool includes a first ball seat defined by a first geometric parameter, and the second tool includes a second ball seat defined by a second geometric parameter, wherein the first geometric parameter is different from the second geometric parameter.

Embodiment 3. The method of any prior embodiment, wherein the first activation pressure for the plug is defined by the first geometric parameter and the second activation pressure for the plug is defined by the second geometric parameter.

Embodiment 4. The method of any prior embodiment, wherein the first geometric parameter includes a first inner diameter of a first bore of the first ball seat and the second geometric parameter includes a second inner diameter of a second bore of the second ball seat.

Embodiment 5. The method of any prior embodiment, wherein the first activation pressure is less than the second activation pressure, the second inner diameter is less than the first inner diameter.

Embodiment 6. The method of any prior embodiment, wherein the first geometric parameter further includes a first taper angle of a first funnel of the first ball seat and the second geometric parameter further includes a second taper angle of a second funnel of the second ball seat.

Embodiment 7. The method of any prior embodiment, wherein the first activation pressure is less than the second activation pressure, the second taper angle is less than the first taper angle.

Embodiment 8. The method of any prior embodiment, wherein the plug used to activate the first tool and the plug used to activate the second tool are the same.

Embodiment 9. A work string. The work string includes a first tool having a first ball seat configured to activate when a first activation pressure is applied to a plug seated at the first ball seat, and a second tool having a second ball seat configured to activate when a second activation pressure is applied to the plug when seated at the second ball seat, wherein the first activation pressure is different than the second activation pressure.

Embodiment 10. The work string of any prior embodiment, wherein the first ball seat is defined by a first geometric parameter, and the second ball seat is defined by a second geometric parameter, wherein the first geometric parameter is different from the second geometric parameter.

Embodiment 11. The work string of any prior embodiment, wherein the first activation pressure for the plug is defined by the first geometric parameter and the second activation pressure for the plug is defined by the second geometric parameter.

Embodiment 12. The work string of any prior embodiment, wherein the first geometric parameter includes a first inner diameter of a first bore of the first ball seat and the second geometric parameter includes a second inner diameter of a second bore of the second ball seat.

Embodiment 13. The work string of any prior embodiment, wherein the first activation pressure is less than the second activation pressure, the second inner diameter is less than the first inner diameter.

Embodiment 14. The work string of any prior embodiment, wherein the first geometric parameter further includes a first taper angle of a first funnel of the first ball seat and the second geometric parameter further includes a second taper angle of a second funnel of the second ball seat.

Embodiment 15. The work string of any prior embodiment, wherein the first activation pressure is less than the second activation pressure, the second taper angle is less than the first taper angle.

Embodiment 16. A work string. The work string including a first tool having a first ball seat, wherein a plug is extruded through the first ball seat when a fluid pressure is applied to the plug above an extrusion pressure of the first ball seat, and a second tool having a second ball seat, wherein the plug is activated with a fluid pressure is applied to the plug above an activation pressure of the second ball seat when the plug is seated at the second ball seat, wherein the first tool receives the plug before the second tool receives the plug and wherein the plug at the first ball seat blocks a fluid pressure at the second tool.

Embodiment 17. The work string of any prior embodiment, wherein the extrusion pressure of the first ball seat is greater than an activation of the second ball seat.

Embodiment 18. The work string of any prior embodiment, further comprising a third tool through which the plug passes before landing at the first tool, wherein a fluid pressure applied to the work string below the extrusion pressure of the first tool when the plug is seated at the first tool activates the third tool.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A work string, comprising:

a first tool having a first ball seat configured to receive a plug for activation of the first tool and having a first diameter that allows the plug to be extruded through the first ball seat when a fluid pressure is applied to the plug above an extrusion pressure of the first ball seat; and a second tool having a second ball seat configured to receive the plug for activation of the second tool and having a second diameter that allows the plug to be extruded through the second ball seat when the fluid pressure is applied to the plug above an activation pressure of the second ball seat when the plug is seated at the second ball seat, wherein the first tool is configured to receive the plug before the second tool receives the plug and wherein the plug blocks a fluid pressure at the second tool when seated at the first ball seat; and a third tool between the first tool and the second tool, wherein the third tool is configured to seat the plug for activation of the first tool without activation of the second tool, wherein the plug is subsequently received at the second tool.

2. The work string of claim 1, wherein the extrusion pressure of the first ball seat is greater than an activation pressure of the second ball seat.

3. A method of performing a downhole operation, comprising:

dropping a plug through a string in a wellbore, the string having a first tool configured to be activated at a first activation pressure when the plug is seated at the first tool, a second tool configured to be activated at a second activation pressure when the plug is seated at the second tool, the second activation pressure being different from the first activation pressure, and a third tool between the first tool and the second tool;

seating the plug at the third tool; and applying a pressure to activate the first tool with the plug seated at the third tool, wherein the plug seated at the third tool prevents pressure from activating the second tool; and receiving the plug at the second tool.

* * * * *